US011167570B2

(12) United States Patent
Mamiya et al.

(10) Patent No.: US 11,167,570 B2
(45) Date of Patent: Nov. 9, 2021

(54) IMAGE FORMING APPARATUS AND IMAGE FORMING METHOD

(71) Applicant: Konica Minolta, Inc., Tokyo (JP)

(72) Inventors: Yusuke Mamiya, Nagoya (JP); Yusuke Nishisaka, Mitaka (JP); Shinya Tokutake, Okazaki (JP); Hajime Kawakami, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/727,401

(22) Filed: Dec. 26, 2019

(65) Prior Publication Data

US 2020/0247142 A1 Aug. 6, 2020

(30) Foreign Application Priority Data

Feb. 6, 2019 (JP) ..... JP2019-019654

(51) Int. Cl.
*B41J 11/00* (2006.01)
*B41J 2/005* (2006.01)

(52) U.S. Cl.
CPC ..... *B41J 11/002* (2013.01); *B41J 2/0057* (2013.01)

(58) Field of Classification Search
None
See application file for complete search history.

(56) References Cited

U.S. PATENT DOCUMENTS

2008/0018695 A1* 1/2008 Kadomatsu ..... B41J 11/002 347/21
2009/0317555 A1* 12/2009 Hori ..... B41J 29/393 427/428.06
2011/0086946 A1* 4/2011 Kotake ..... H01L 51/052 523/400

FOREIGN PATENT DOCUMENTS

JP H01-169649 A 9/1998
JP 2009051118 A 3/2009

* cited by examiner

*Primary Examiner* — Erica S Lin
(74) *Attorney, Agent, or Firm* — Lucas & Mercanti, LLP

(57) ABSTRACT

An inkjet-type image forming apparatus, includes: an intermediate transfer body that has an outmost surface layer and transfers a photo-curable ink to a recording medium; a light irradiator that performs a tentative-curing treatment by photo-curing the photo-curable ink after the ink is landed on the intermediate transfer body and before the landed ink is transferred to the recording medium; a temperature controller that causes the outmost surface layer to be melted, expanded, or contracted; and a transferor that transfers the photo-curable ink landed on the intermediate transfer body to the recording medium.

16 Claims, 4 Drawing Sheets

IMAGE FORMING APPARATUS AND IMAGE FORMING METHOD

The entire disclosure of Japanese patent Application No. 2019-019654, filed on Feb. 6, 2019, is incorporated herein by reference in its entirety.

BACKGROUND

Technological Field

The present invention relates to an image forming apparatus and an image forming method.

Description of the Related Art

As a method for recording on a recording medium using a liquid ink, an ink jet method in which a liquid ink is ejected from an inkjet head and landed on a recording medium is generally known.

In the inkjet method, a dot diameter of a liquid ink landed on a recording medium may vary depending on surface roughness of the recording medium on which the liquid ink is landed, properties of the liquid ink of being absorbed in the recording medium, or the like. As a method for solving these problems, an intermediate transfer type inkjet system in which a liquid ink is ejected toward a belt- or roller-shaped intermediate transfer body and thereafter the liquid ink is transferred to a recording medium is known. In this system, at the time of transferring the liquid ink on the intermediate transfer body to the recording medium, the intermediate transfer body is pressed against the recording medium to increase adhesive strength between the liquid ink and the recording medium.

However, since a pressure is applied at the time of transferring, there is a problem that destruction of a liquid ink droplet on the recording medium occurs and the formed image is deformed. Accordingly, a method for stabilizing (tentatively curing) the shape of a liquid ink droplet by thickening or curing the liquid ink droplet within a short time after the liquid ink is ejected toward an intermediate transfer body and before the liquid ink is transferred to a recording medium is known (see JP 10-250052 A and JP 2009-051118). JP 10-250052 A and JP 2009-051118 A each disclose a method for a tentative-curing treatment of a liquid ink droplet on an intermediate transfer body.

In the method disclosed in JP 10-250052 A, a primary image formed of liquid ink droplets on an intermediate transfer body is firstly irradiated with UV light to perform a tentative-curing treatment of the primary image. Next, a secondary image formed of the liquid ink droplets is formed by transferring the tentative-curing treated primary image to a recording medium. Finally, the secondary image is further irradiated with UV light to cure the liquid ink droplets.

In the method disclosed in JP 2009-051118 A, an intermediate transfer body in which a precoat layer containing an ingredient which causes aggregation of pigments in a liquid ink droplet is formed on the surface of the intermediate transfer body is used. A liquid ink is landed on the intermediate transfer body, and a primary image is formed on the precoat layer. At this time, the ingredient, which causes aggregation of pigments in a liquid ink droplet, in the precoat layer and the pigments in the liquid ink droplet react with each other to lead aggregation of the pigments, and accordingly the primary image is tentative-curing treated.

The tentative-curing treated primary image is heated and transferred to a recording medium to form a secondary image.

However, in the method described in JP 10-250052 A, when irradiation dose of UV light in the tentative-curing treatment is increased, curing of the liquid ink droplet is facilitated. Thus, the shape of the liquid ink droplet is stabilized, but efficiency of transfer from the intermediate transfer body to the recording medium may decreases. In the method described in JP 2009-051118 A, since the liquid ink droplet has not cured at the time of transferring from the intermediate transfer body to the recording medium, the secondary image formed on the recording medium may be blurred by a difference in feeding speeds between the intermediate transfer body and the recording medium.

SUMMARY

An object of the present invention is to provide an image forming apparatus and an image forming method which are capable of ensuring image quality of a secondary image formed on a recording medium while efficiency of transfer to the recording medium is maintained.

To achieve the abovementioned object, according to an aspect of the present invention, an inkjet-type image forming apparatus reflecting one aspect of the present invention comprises: an intermediate transfer body that has an outmost surface layer and transfers a photo-curable ink to a recording medium; a light irradiator that performs a tentative-curing treatment by photo-curing the photo-curable ink after the ink is landed on the intermediate transfer body and before the landed ink is transferred to the recording medium; a temperature controller that causes the outmost surface layer to be melted, expanded, or contracted; and a transferor that transfers the photo-curable ink landed on the intermediate transfer body to the recording medium.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

(Image Forming Apparatus)

Figure 1:
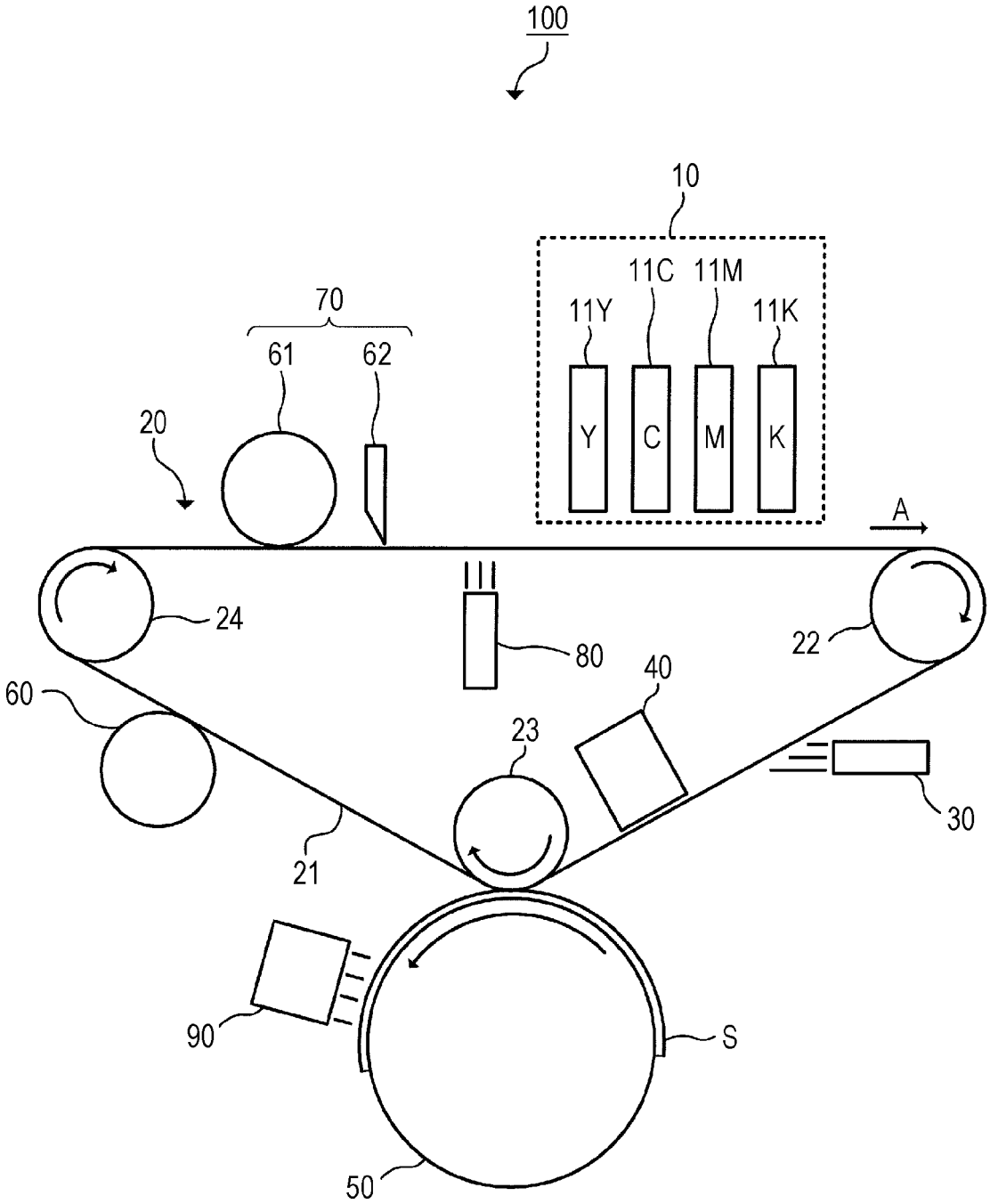
FIG. 1 is a schematic view illustrating a configuration of an image forming apparatus.

FIG. 1 is a schematic view illustrating a configuration of an image forming apparatus. As shown in FIG. 1, an image forming apparatus 100 is an intermediate transfer type image forming apparatus using an inkjet method. The image forming apparatus 100 includes an ink provider 10, an intermediate transferor (transferor) 20, a light irradiator 30, a temperature controller 40, a transporter 50, a cleaner 60, a precoat agent provider 70, a thickener 80, and a photo-curer 90. In this embodiment of the present invention, the precoat agent provider 70 and the thickener 80 correspond to a layer former according to claims.

As shown in FIG. 1, the ink provider 10 includes inkjet heads 11Y, 11C, 11M, and 11K. The ink provider 10 ejects an ink as an example of a coating material having each color of yellow (Y), magenta (M), cyan (C), and black (K) toward the intermediate transferor 20. The inkjet heads 11Y, 11C, 11M, and 11K have the same configuration, and thus the suffix Y, M, C, or K will be omitted from the following description.

An ink ejected from the inkjet head 11 is an active light curable ink (hereinafter, also simply referred to as an "ink") containing a photopolymerizable compound, as a liquid component, which is cured by polymerization and cross-linking by irradiation with active light such as ultraviolet rays and electron rays. The ink will be described in detail later.

The intermediate transferor 20 includes an intermediate transfer body 21, and three support rollers 22, 23, and 24. In the present embodiment, the intermediate transfer body 21 is an endless belt, and is stretched by the three support rollers 22, 23, and 24 in the shape of an inverted triangle.

In the three support rollers 22, 23, and 24, at least one roller is a driving roller, and rotates the intermediate transfer body 21 in an A direction (in the clockwise direction in FIG. 1).

The intermediate transfer body 21 includes a base material layer. The intermediate transfer body 21 may include an elastic layer and a surface layer on a surface of the base material layer. The intermediate transfer body 21 may include a precoat layer P which is disposed on a surface of the base material layer or the surface layer. When the intermediate transfer body 21 consists only of a base material layer, the base material layer corresponds to an outmost surface layer according to claims. When the intermediate transfer body 21 includes a base material layer, an elastic layer, and a surface layer, the surface layer corresponds to an outmost surface layer according to claims. When the intermediate transfer body 21 includes a precoat layer P, the precoat layer P corresponds to an outmost surface layer according to claims. In the present embodiment, from the viewpoint of durability of the intermediate transfer body 21, the outmost surface layer is preferably a precoat layer P. That is, in the present embodiment, the intermediate transfer body 21 preferably include a base material layer, an elastic layer, a surface layer, and a precoat layer P.

The outmost surface layer preferably include a thermoplastic resin. When the outmost surface layer include a thermoplastic resin, in a step described below, the outmost surface layer is melted by heating, and thus transferring to a recording medium is facilitated. Examples of the thermoplastic resin include low-density polyethylene, polystyrene, acryl, and vinyl chloride. The thermoplastic resin preferably has a low glass transition temperature.

The outmost surface layer preferably contains a particle. When the outmost surface layer contains a particle, in a temperature controlling step described below, by heating or cooling, the outmost surface layer is expanded or contracted, thus the shape of a surface of the outmost surface layer is changed from plane to a rugged shape, and transferring to a recording medium is facilitated. Examples of the particle include a shell-structured particle in which an air bubble is contained in the interior of the particle. Examples of a material of the particle include glass. The particle has a particle size of about 10 μm.

The outmost surface layer preferably does not contain an ingredient which causes aggregation of an ink. Herein, an "ingredient which causes aggregation of an ink" refers to a material which breaks a dispersion state of a paint or a pigment dispersed in the ink to cause precipitation, or thickens the solvent itself. Examples of the ingredient which causes aggregation of an ink include an organic mordant such as a metal ion or polyallylamine, a treatment agent having a pH which is different from the pH of the ink, a gelling agent such as boric acid or polyvinyl alcohol (PVA), and an anti-gelling agent.

The metal ion reacts with a pigment dispersed in an ink and breaks a dispersion or dissolution state to cause aggregation of the ink. The organic mordant reacts with an anionic paint dispersed in an ink and fixes dyes to cause aggregation of the ink. The treatment agent having a pH which is different from the pH of an ink changes the pH of the ink and precipitates pigments and dyes to cause aggregation of the ink. The gelling agent reacts with an ink at the time of ejection, and causes the ink to form a gel.

In the intermediate transfer body 21, a portion stretched between the support rollers 22 and 24 which are positioned at the right and left vertex portions of the inverted triangle, respectively, is an ink landing surface on which an ink ejected from each of the inkjet heads 11 lands. In the intermediate transfer body 21, the support roller 23 which is positioned at the lower vertex portion of the inverted triangle is a pressure roller which presses the intermediate transfer body 21 against a transporter 50 with a predetermined nip pressure, and functions as a transferor which transfers an intermediate image, which is formed by landing of the ink ejected from the inkjet heads 11, to a recording medium S.

The light irradiator 30 is disposed between the ink provider 10 and a transfer nip. The light irradiator 30 performs a tentative-curing treatment by photo-curing (partial curing) of an ink after the ink is landed on the intermediate transfer body 21 and before the landed ink is transferred to the recording medium S. Examples of the light irradiator 30 include a UV-LED light and a UV-metal halide lamp. The irradiation intensity of the light radiated from the light irradiator 30 is 0.5 to 0.8 W/cm$^2$. If the irradiation intensity of the light is too weak, dot destruction of the ink occurs. On the other hand, if the irradiation intensity of the light is too strong, the ink is excessively cured by the light and the transfer rate of the ink decreases.

The temperature controller 40 alters temperatures of the tentative-curing treated ink and the intermediate transfer body 21. The temperature controller 40 may alter the temperatures from the front-surface side which is a side opposite to the intermediate transfer body 21, or may alter the temperatures from the back-surface side which is an intermediate transfer body 21 side. The temperature controller 40 heats the outmost surface layer to a glass transition temperature of the thermoplastic resin or higher, and thereby causes the outmost surface layer to be melted. Alternatively, the temperature controller 40 heats or cools the outmost surface layer, and thus causes the outmost surface layer to be expanded or contracted. A configuration of the temperature controller 40 is not particularly limited as long as the temperature controller 40 can perform the above-described functions. Examples of the temperature controller 40 include a halogen heater, an IH heater, and a rubber heater.

The transporter 50 includes, for example, a metal drum, and is biased toward the support roller 23 to form a transfer nip. The transporter 50 has a claw (not illustrated) to which an end of the recording medium S is fixed. The transporter 50 fixes an end of the recording medium S to the claw, rotates in a counterclockwise direction in FIG. 1, and thereby transports a sheet, which is an example of the recording medium S, to the transfer nip.

The ink that has been ejected from each of the inkjet heads 11 and has been landed on the surface of the intermediate transfer body 21 (intermediate image) is transported to the transfer nip, which is constituted by the support roller 23 and the transporter 50, by the rotation of the intermediate transfer body 21. Then, the ink transported to the transfer nip is transferred to the recording medium S by the transporter 50.

The cleaner 60 is a cleaning roller such as a web roller or a sponge roller, and is in contact with the intermediate transfer body 21 at a portion on a downstream side of the transfer nip. The cleaner 60 is driven and rotated under the control of the controller, and thus removes an ink residue (remaining coating material) which has not been transferred to the recording medium S at the transfer nip and remains on the intermediate transfer body 21.

The precoat agent provider 70 has a roll coater 61 of which a surface is covered with a sponge, and a scraper 62. The roll coater 61 provides a precoat agent to the ink landing surface side of the intermediate transfer body 21. The scraper 62 removes the excessive precoat agent to achieve a smooth surface of the provided precoat agent, and forms a precoat layer P in which the precoat agent spreads on the ink landing surface side of the intermediate transfer body 21 with a predetermined thickness. The precoat agent provider 70 may provide the precoat agent by a method using a bar coater or an inkjet method.

The thickener 80 is disposed to face the intermediate transfer body 21 on a downstream side of the precoat agent provider 70 and upstream side of the ink provider 10, and cures the precoat agent on the intermediate transfer body 21.

The photo-curer 90 is disposed on a downstream side of the transfer nip. The photo-curer 90 irradiates the ink on the intermediate transfer body 21 with active light to achieve actual curing of the ink. The photo-curer 90 may have a configuration which is the same as that of the light irradiator 30.

In the exemplary embodiments described above, the exemplary intermediate transfer body 21 has a precoat layer P. However, when the intermediate transfer body 21 does not have a precoat layer P, the above-described precoat agent provider 70 and the above-described thickener 80 are not necessary.

(Image Forming Method)

Next, an image forming method according to the present embodiment will be described. FIGS. 2A to 2H are schematic views for illustrating an inkjet-type image forming method according to the present embodiment. FIG. 3 is a flowchart illustrating an inkjet-type image forming method according to the present embodiment.

The inkjet-type image forming method according to the present embodiment includes a light irradiation step of performing a tentative-curing treatment by photo-curing a photo-curable ink after the photo-curable ink is landed on an intermediate transfer body which has an outmost surface layer and before the landed photo-curable ink is transferred to a recording medium; a temperature controlling step of melting, expanding, or contracting the outmost surface layer; and a transfer step of transferring the photo-curable ink landed on the intermediate transfer body to a recording medium.

In the present embodiment, first, the precoat agent is provided to the ink landing surface among surfaces of the intermediate transfer body (step S111).

It is sufficient that the precoat agent is provided at least in a region, within the ink landing surface, on which the ink is landed. A method for providing the precoat agent is not particularly limited, and a method using a roll coater, a bar coater, and the like, and an inkjet method can be used.

The precoat agent is provided to the ink landing surface, and, if necessary, is smoothened by a scraper or the like. The thickness of the provided precoat agent is, from the viewpoint of reducing a decrease in transfer properties due to sinking (infiltration) of the landed ink in the precoat layer P in the subsequent step, preferably less than the thickness of the ink of an image to be formed, and is preferably 0.5 μm or more and 1.0 μm or less, for example.

The partial curing refers to a state in which the precoat agent is not completely cured and there is a room for further curing of the precoat agent, and a state in which the precoat agent has some degree of flexibility or fluidity. Independent of types of the precoat agents, when the precoat agent contains a thermoplastic resin, transfer properties can be increased by heating and softening the precoat layer P in the subsequent transfer step. Thus, the partial curing of the precoat agent may be performed even to the extent that adhesiveness of the precoat agent to the recording medium at normal temperature decreases.

Figure 2A:
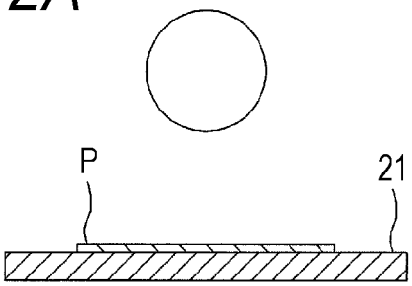
FIGS. 2A to 2H are schematic views for illustrating an image forming method.
Figure 2B:
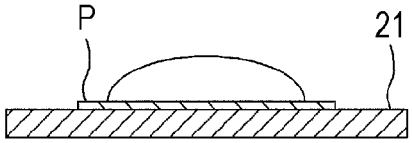
Figure 3:
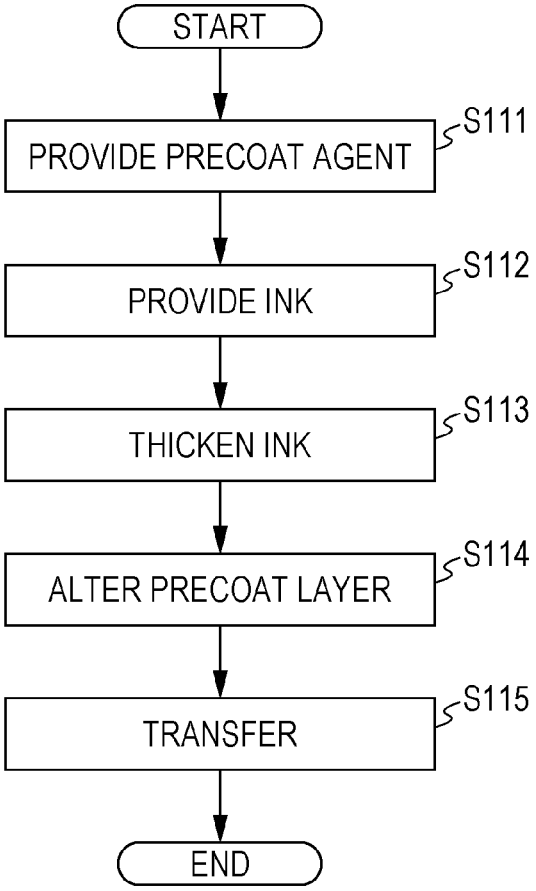
FIG. 3 is a flowchart of an image forming method.

As shown in FIGS. 2A and 2B, the ink is provided to the surface of the provided precoat agent (formed precoat layer P) by an inkjet method (step S112).

The ink is ejected from an inkjet head, and is landed on the surface of the provided precoat agent, or is landed on the surface of the previously landed ink. At this time, a color ink corresponding to an image to be formed is ejected and landed, and thus an ink layer is formed on the surface of the precoat layer P, and an intermediate image is formed on the ink landing surface of the intermediate transfer body.

The surface energy of the outmost surface layer before landing of the ink is preferably larger than the surface energy of the outmost surface layer after landing of the ink. The surface energy of the outmost surface layer after landing of the ink is more preferably 30 mN/m or more. When the surface energy of the outmost surface layer before landing of the ink is larger than the surface energy of the outmost surface layer after landing of the ink, the ink diameter can be expanded at the time of landing of the ink, and thus the amount of ink usage can be reduced.

A method for measuring the surface energy of the outmost surface layer is not particularly limited. The surface energy of the outmost surface layer can be measured by a highest bubble pressure method. As a measuring device, a Bubble Pressure Tensiometer "BP100" (manufactured by KRUSS GmbH) can be used. Surface tension can be obtained by introducing a gas into a liquid such as an ink composition liquid according to the present embodiment through a capillary, and calculating the surface tension from the maximum pressure of the bubble of the gas. The measurement of the surface tension (surface energy) is carried out for 10 seconds. When the outmost surface layer is a precoat layer P, the surface energy of the precoat layer P before landing of an ink may be a typical surface energy of the material used. Generally, the surface energy tends to decrease as the temperature increases.

Figure 2C:
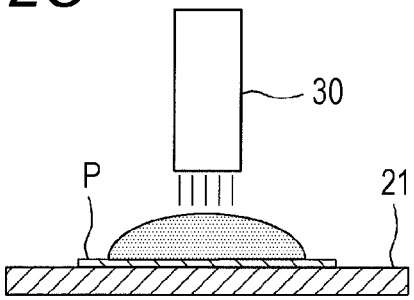
Figure 2D:
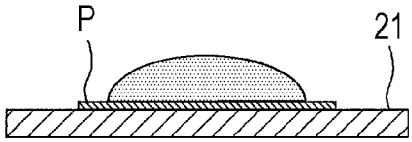

Next, as shown in FIGS. 2C and 2D, the intermediate image landed on the outmost surface layer is subjected to a tentative-curing treatment by a light irradiator (light irradiation step). In the present embodiment, the ink is photo-cured after the ink is landed on the intermediate transfer body and before the landed ink is transferred to the recording medium (tentative-curing). The tentative-curing may be performed by photo-curing the ink by irradiation with active light such as ultraviolet rays, for example (step S113).

Next, the outmost surface layer is altered by a temperature controller (step S114) (temperature controlling step). At this time, the outmost surface layer is melted, expanded, or contracted by the temperature controller. Specifically, before transferring the photo-curable ink to the recording medium, the outmost surface layer is heated to a glass transition temperature of the thermoplastic resin or higher, and thus the outmost surface layer is melted. The heating may be performed so that the temperature becomes a softening point of the precoat agent or higher and does not cause deformation of the intermediate transfer body and the recording medium by the heat, and can be performed so that the heated precoat layer P and the heated ink layer become 100° C. or higher and 130° C. or lower. Accordingly, at the time of transferring to the recording medium, the adhesive strength between the ink (intermediate image) and the intermediate transfer body (precoat layer P) becomes smaller than the adhesive strength between the ink (intermediate image) and the recording medium, and thus the ink (intermediate image) can be properly transferred to the recording medium.

Figure 2E:
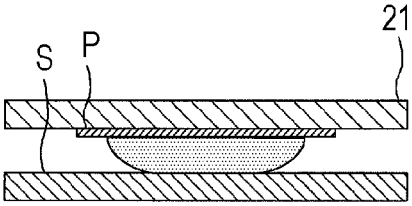
Figure 2F:
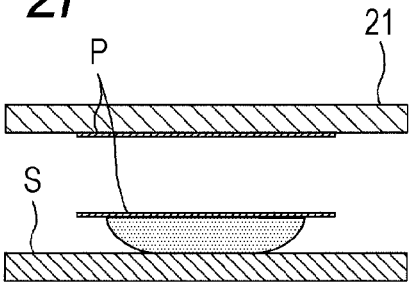

Next, as shown in FIGS. 2E and 2F, the precoat layer P and the ink layer formed by providing the ink are transferred to the recording medium (transfer step) (step S115).

The intermediate transfer body in which the precoat layer P and the ink layer is formed on the surface of the intermediate transfer body is pressed against the transported recording medium, and thereby the precoat layer P and the ink layer is transferred to the recording medium.

Figure 2G:
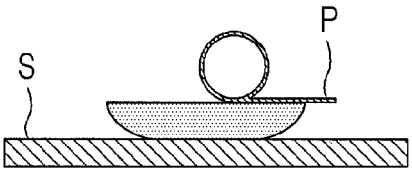
Figure 2H:
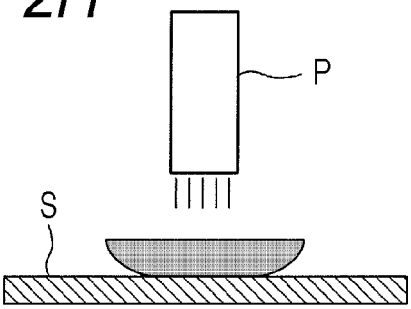

As shown in FIG. 2H, the ink is completely cured by a photo-curer to form an image. The complete curing can be performed by curing the precoat agent and the ink by irradiation with active light such as ultraviolet rays, for example.

As shown in FIG. 2G, a step of removing the residual precoat layer P which stays on the surface of the ink transferred to the recording medium may be included.

Figure 4A:
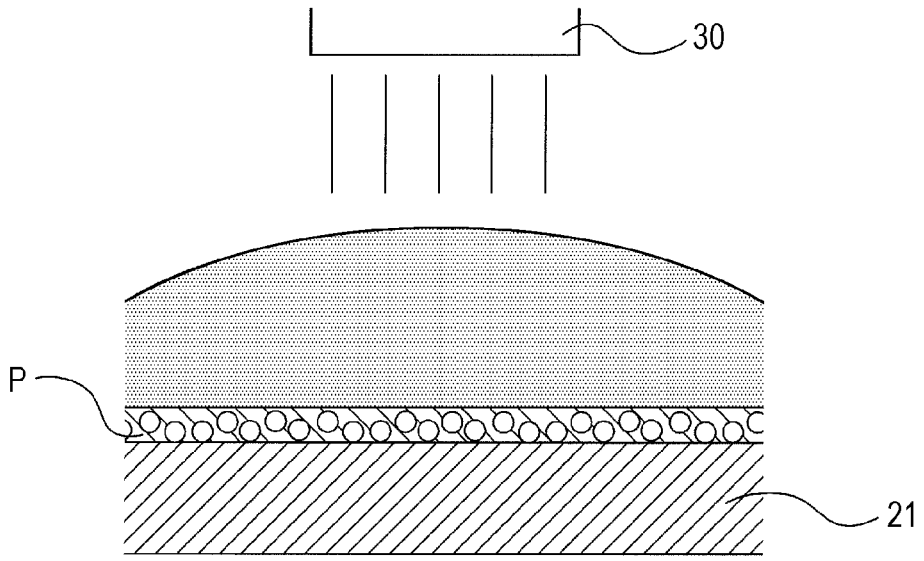
FIGS. 4A and 4B are schematic views for illustrating other image forming methods.
Figure 4B:
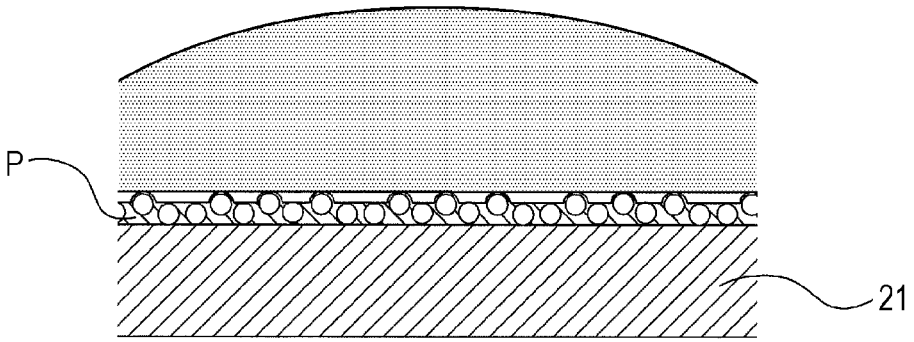

As shown in FIGS. 4A and 4B, when particles are included in the outmost surface layer, the shape of the surface of the outmost surface layer is changed to a rugged shape by heating or cooling of the outmost surface layer. Accordingly, when the ink is transferred to the recording medium, the adhesive strength between the intermediate transfer body and the ink becomes smaller than the adhesive strength between the ink and the recording medium.

[Precoat Agent]

As a precoat agent, a material which is obtained by heat melting polypropylene and thereafter mixing the heat melted polypropylene with silicone oil for maintaining flexibility can be used, for example.

[Ink]

An ink is not particularly limited, and may be any usual active light curable ink used for forming an image by an inkjet method.

(Material of Ink)

For example, when the ink is a water-based ink, the ink may contain water and optionally contain a water-soluble organic solvent. When the ink is a solvent-based ink, the ink may contain an organic solvent. Since the ink is an active light curable ink, the ink contains a photopolymerizable compound which is polymerized and crosslinked by irradiation with active light, and optionally contains a photopolymerization initiator.

The ink may further contain, if necessary, a color material such as a dye and a pigment, a dispersant for dispersing the pigment, a fixing resin for fixing the pigment to a substrate, a surfactant, a polymerization inhibitor, an ultraviolet absorber, and a gelling agent for sol-gel phase transition of the ink by a change in temperature, and the like. The auxiliary ingredients may be used alone, or in combination of two or more.

Examples of the water-soluble organic solvent, when the ink is a water-based ink, include alcohols such as methanol, ethanol, propanol, isopropanol, butanol, isobutanol, sec-butanol, and t-butanol; glycerols such as ethylene glycol, diethylene glycol, triethylene glycol, polyethylene glycol, propylene glycol, dipropylene glycol, polypropylene glycol, butylene glycol, hexanediol, and pentanediol; polyvalent alcohols such as hexanetriol, thiodiglycol, 1,2-butanediol, 1,3-butanediol, 1,2-pentanediol, 1,2-hexanediol, and 1,2-heptanediol; amines such as ethanolamine, diethanolamine, triethanolamine, N-methyldiethanolamine, N-ethyldiethanolamine, morpholine, N-ethylmorpholine, ethylenediamine, diethylenediamine, triethylenetetramine, tetraethylenepentamine, polyethyleneimine, pentamethyldiethylenetriamine, and tetramethylpropylenediamine; amides such as formamide, N,N-dimethylformamide, and N,N-dimethylacetamide; heterocyclic compounds such as 2-pyrrolidone, N-methyl-2-pyrrolidone, cyclohexylpyrrolidone, 2-oxazolidone, and 1,3-dimethyl-2-imidazolidinone; sulfoxides such as dimethyl sulfoxide; glycol ethers such as ethylene glycol monomethyl ether, ethylene glycol monoethyl ether, ethylene glycol monobutyl ether, ethylene glycol diethyl ether, ethylene glycol dimethyl ether, diethylene glycol monomethyl ether, diethylene glycol monoethyl ether, diethylene glycol monobutyl ether, diethylene glycol ethyl methyl ether, diethylene glycol dimethyl ether, diethylene glycol diethyl ether, diethylene glycol dibutyl ether, propylene glycol monomethyl ether, propylene glycol monoethyl ether, propylene glycol monobutyl ether, dipropylene glycol monomethyl ether, dipropylene glycol monoethyl ether, propylene glycol dimethyl ether, dipropylene glycol dimethyl ether, propylene glycol diethyl ether, dipropylene glycol diethyl ether, ethylene glycol monomethyl acetate, ethylene glycol monoethyl acetate, ethylene glycol monobutyl acetate, diethylene glycol monomethyl acetate, ethylene glycol monomethyl ether acetate, ethylene glycol monoethyl ether acetate, ethylene glycol monobutyl ether acetate, propylene glycol monomethyl ether acetate, propylene glycol monoethyl ether acetate, diethylene glycol monoethyl acetate, diethylene glycol monobutyl acetate, and triethylene glycol monobutyl ether.

The content of the water-soluble organic solvent, when the ink is a water-based ink, is preferably 5.0 mass % or more and 30 mass % or less with respect to the total mass of the ink, for example.

Examples of the organic solvent, when the ink is a solvent-based ink, include a water-soluble organic solvent which can be used for a water-based ink and a water-insoluble organic solvent.

Examples of the water-insoluble organic solvent include $C_5$-$C_{15}$ aliphatic hydrocarbons such as pentane, hexane, i-hexane, heptane, i-heptane, octane, i-octane, and decane; $C_5$-$C_{15}$ alicyclic hydrocarbons such as cyclopentane, cyclohexane, methylcyclohexane, dimethylcyclohexane, ethylcyclohexane, cycloheptane, and cyclooctane; $C_5$-$C_{15}$ cyclic unsaturated hydrocarbons such as cyclohexene, cycloheptene, cyclooctene, 1,1,3,5,7-cyclooctatetraene, and cyclododecene; $C_6$-$C_{12}$ aromatic hydrocarbons such as benzene, toluene, ethylbenzene, cumene, o-xylene, m-xylene, and p-xylene; $C_5$-$C_{15}$ monohydric alcohols such as heptanol, hexanol, methylhexanol, ethylhexanol, heptanol, octanol, decanol, undecyl alcohol, and lauryl alcohol; $C_5$-$C_{15}$ alicyclic ketones such as methyl isobutyl ketone, diisobutyl ketone, cyclohexanone, methylcyclohexanone, cycloheptanone, and cyclooctanone; ester compounds such as methyl acetate, ethyl acetate, propyl acetate, i-propyl acetate, butyl acetate, hexyl acetate, amyl acetate, i-amyl acetate, 2-ethylhexyl acetate, methyl propionate, ethyl propionate, butyl propionate, hexyl propionate, amyl propionate, ethyl valerate, ethyl hexanoate, ethyl heptanoate, ethyl octanoate, ethyl decanoate, cyclohexyl acetate, cyclooctyl acetate, phenyl acetate, phenyl propionate, methyl benzoate, ethyl benzoate, butyl benzoate, dimethyl phthalate, diethyl phthalate, and dibutyl phthalate; nitro compounds such as nitroethane, nitropropane, nitropentane, nitrobenzene, dinitrobenzene, nitrotoluene, and nitroxylene; nitriles such as acetonitrile and benzonitrile; and lactones such as γ-butyrolactone and ε-caprolactone.

The content of the water-insoluble organic solvent, when the ink is a solvent-based ink, is preferably 1.0 mass % or more and 98 mass % or less, more preferably 20 mass % or more and 95 mass % or less, and even more preferably 40 mass % or more and 90 mass % or less with respect to the total mass of the ink, for example.

Examples of the photopolymerizable compound include compounds described as examples for the precoat agent. The photopolymerizable compound may be a monomer, a polymerizable oligomer, or a mixture thereof.

The content of the photopolymerizable compound is, for example, preferably 1.0 mass % or more and 97 mass % or less, and more preferably 30 mass % or more and 90 mass % or less with respect to the total mass of the ink.

It is sufficient that the photopolymerization initiator can initiate polymerization of a photopolymerizable compound. For example, the photopolymerization initiator can be a photoradical initiator. Further, when the ink includes a cationic polymerizable compound, the photopolymerization initiator can be a photocationic initiator (photo-acid-generating agent).

The content of the photopolymerization initiator can be arbitrarily determined within a range in which the ink is sufficiently cured by irradiation with active light and ejection properties of the ink is not degraded. For example, the content is preferably 0.1 mass % or more and 20 mass % or less, and more preferably 1.0 mass % or more and 12 mass % or less with respect to the total mass of the ink. When the ink can be sufficiently cured without using a photopolymerization initiator, for example, when the ink is cured by irradiation with electron rays, a photopolymerization initiator is not necessary.

Examples of the color material include dyes and pigments. From the viewpoint of forming an image having excellent weather resistance, the color material is preferably a pigment. The pigment can be selected, according to the color of the image to be formed, from a yellow pigment, a red or magenta pigment, a blue or cyan pigment, and a black pigment, for example.

It is sufficient that the dispersant can sufficiently disperse a pigment. Examples of the dispersant include a hydroxyl group-containing carboxylic ester, a salt of long-chain polyaminoamide and macromolecular acid ester, a salt of a macromolecular polycarboxylic acid, a salt of long-chain polyaminoamide and polar acid ester, a macromolecular unsaturated acid ester, a macromolecular copolymer, modified polyurethane, modified polyacrylate, a polyether ester type anionic activator, a naphthalenesulfonate formaldehyde condensate, an aromatic sulfonate formaldehyde condensate, a polyoxyethylene alkylphosphate ester, polyoxyethylene nonylphenyl ether, and stearylamine acetate.

The content of the dispersant is, for example, preferably 20 mass % or more and 70 mass % or less with respect to the total mass of the pigment.

Example of the fixing resin include a (meth)acrylic resin, an epoxy resin, a polysiloxane resin, a maleic acid resin, a vinyl resin, a polyamide resin, nitrocellulose, cellulose acetate, ethyl cellulose, an ethylene-vinyl acetate copolymer, a urethane resin, a polyester resin, and an alkyd resin.

The content of the fixing resin is, for example, preferably 1.0 mass % or more and 10.0 mass % or less with respect to the total mass of the ink. Since the particle can change to amorphous and form a coating by itself, the ink may be even substantially free of a fixing resin.

Examples of the surfactant include anionic surfactants such as dialkyl sulfosuccinates, alkyl naphthalene sulfonates, and fatty acid salts; nonionic surfactants such as polyoxyethylene alkyl ethers, polyoxyethylene alkylallyl ethers, acetylene glycols, and polyoxyethylene-polyoxypropylene block copolymers; cationic surfactants such as alkyl amine salts and quaternary ammonium salts; silicone-based surfactants; and fluorine-based surfactants.

The content of the surfactant is preferably 0.001 mass % or more and 5.0 mass % or less with respect to the total mass of the ink.

Examples of the gelling agent include ketone wax; ester wax; petroleum-based wax; botanical wax; animal wax; mineral-based wax; hydrogenated castor oil; modified wax; higher fatty acids; higher alcohols; hydroxy stearic acid; fatty acid amides such as N-substituted fatty acid amides and special fatty acid amides; higher amines; esters of sucrose fatty acids; synthetic wax; dibenzylidene sorbitol; dimer acids; and dimer diols. Among these, from the viewpoint of further increasing tentative-curing properties of the ink, preferred are ketone wax, ester wax, higher fatty acids, higher alcohols, and fatty acid amides, and more preferred are ketone wax and ester wax in which each of the carbon chains arranged on both sides of a keto group of the ketone wax or an ester group of the ester wax has 9 to 25 carbon atoms.

The content of the gelling agent is preferably 10 mass % or more and 10.0 mass % or less with respect to the Total Mass of the Ink.

(Physical Properties of Ink)

From the viewpoint of further increasing ejection properties of the ink ejected from the inkjet head, when the ink is a gelling agent-free ink, the viscosity of the ink at 40° C. is preferably 3 mPa·s or more and 20 mPa·s or less. When the ink is an ink containing a gelling agent, the viscosity of the ink at 80° C. is preferably 3 mPa·s or more and 20 mPa·s or less.

When the ink contains a gelling agent, the ink preferably has a phase transition temperature, at which the ink experiences sol-gel phase transition, of 40° C. or more and 70° C. or less. When the phase transition temperature of the ink is 40° C. or more, the ink thickens immediately after landing on a substrate, and thus wetting and spreading extent can be more easily controlled. When the phase transition temperature of the ink is 70° C. or less, the ink hardly forms a gel when the ink is ejected from an ejection head in which an ink temperature is normally about 80° C., and thus the ink can be more stably ejected.

The viscosity of the ink at 40° C., the viscosity of the ink at 80° C., and the phase transition temperature of the ink can be obtained by measuring a temperature change of dynamic viscoelasticity of the ink using a rheometer. Herein, the values with respect to the viscosity and the phase transition temperature are obtained by the following methods. The ink is heated to 100° C., and the ink is cooled to 20° C. under conditions including a shear rate of 11.7 (1/s) and a temperature dropping rate of 0.1° C./s while the viscosity is measured by a stress-controlled rheometer (Physica MCR301 manufactured by Anton Paar GmbH (cone-plate diameter: 75 mm, cone angle: 1.0°) to obtain a temperature change curve of the viscosity. The viscosity at 40° C. and the viscosity at 80° C. are obtained by reading a viscosity at 40° C. and a viscosity at 80° C. from the temperature change curve of the viscosity, respectively. The phase transition temperature is obtained as a temperature at which a viscosity becomes 200 mPa·s on the temperature change curve of the viscosity.

As described above, in an image forming apparatus and an image forming method according to the present embodiment, a tentative-curing treatment is performed after an ink is landed on an intermediate transfer body and before the landed ink is transferred to a recording medium, and the tentative-curing treated ink is transferred to the recording medium while an outmost surface layer of the intermediate transfer body is in a melted, expanded, or contracted state. Accordingly, when the ink is transferred to the recording medium, the adhesive strength between the intermediate transfer body and the ink becomes smaller than the adhesive strength between the ink and the recording medium, and thus image quality of a secondary image formed on the recording medium can be ensured while efficiency of transfer to the recording medium is maintained.

Examples

Hereinafter, the present invention is specifically described with reference to examples, but the present invention is not limited thereto.

(Preparation of Precoat Agent)

As a precoat agent, a material which was obtained by heat melting polypropylene (Parylene from TOYOBO CO., LTD.) and thereafter mixing the heat melted polypropylene with silicone oil for maintaining flexibility was used.

(Preparation of Ink) A stainless steel beaker was charged with a pigment dispersant, a photopolymerizable compound, and a polymerization inhibitor described below, and the contents were heated and stirred for 1 hour while heated on a hot plate at 65° C.

Pigment dispersant: AJISPER PB824 (manufactured by Ajinomoto Fine-Techno Co., Inc.), 9 parts by mass Photopolymerizable compound: tripropylene glycol diacrylate, 70 parts by mass Polymerization inhibitor: Irgastab UV10 (manufactured by Ciba Japan K.K.), 0.02 parts by mass The resulting mixture was cooled to room temperature, and then 21 parts by mass of Pigment Red 122 (Chromo Fine Red 6112JC manufactured by Dainichiseika Color & Chemicals Mfg. Co., Ltd.) was added to the mixture. A glass bottle was charged with the mixture together with 200 g of zirconia beads each having a diameter of 0.5 mm, hermetically sealed, and the contents were subjected to a dispersion treatment using a paint shaker for 8 hours. Thereafter, the zirconia beads were removed to afford a pigment dispersion 1.

A photopolymerizable compound, a photopolymerization initiator, a polymerization inhibitor, and a surfactant described below, and the above-described pigment dispersant 1 were mixed, heated to 100° C., and stirred. Thereafter, the resulting liquid was filtered by a metal mesh filter of #3000 while heating, and then cooled, and thus an ink was prepared.

Photopolymerizable compound: polyethylene glycol #400 diacrylate, 34.9 parts by mass Photopolymerizable compound: 4EO modified pentaerythritol tetraacrylate, 15.0 parts by mass Photopolymerizable compound: 6EO modified trimethylol propane triacrylate, 23.0 parts by mass Photopolymerization initiator: DAROCUR TPO (manufactured by BASF), 6.0 parts by mass Photopolymerization initiator: ITX (manufactured by DKSH JAPAN K.K.), 1.0 parts by mass Photopolymerization initiator: DAROCUR EDB (manufactured by BASF), 1.0 parts by mass Surfactant: KF-352 (manufactured by Shin-Etsu Chemical Co., Ltd.), 0.1 parts by mass Pigment dispersion 1: 19.0 parts by mass (Image Formation)

An image was formed under the following conditions using an image forming apparatus having a configuration shown in FIG. 1.

The precoat agent provider included a roll coater of which the surface was covered with a sponge, and a scraper. The above-described precoat agent was provided by the precoat agent provider to form a precoat layer.

The thickener was equipped with a UV-LED lamp having an emission wavelength of 395 nm, and irradiation intensity was 1.5 mW/cm$^2$.

The ink provider used was equipped with a piezoelectric inkjet head, an ink tank, a supply pipe, a front chamber ink tank immediately before a recording head, and piping equipped with a filter. As the inkjet head, a line-head type inkjet head which was capable of achieving a recording resolution of 1200 dpi×1200 dpi by piezoelectric heads having a nozzle diameter of 24 μm, having a resolution of 512 dpi, and having a staggered arrangement was used. The ink tank communicated with the inkjet head was charged with an ink. Then, the ink heated to 80° C. and having a volume of 3.5 pl per droplet was ejected at a droplet ejection speed of 6 msec, and landed on the surface of the precoat layer.

The intermediate transfer body was stretched around three support rollers (one of the rollers was a pressure roller) in the shape of an inverted triangle by using an endless belt having a length in an axial direction of 800 mm and having a base material layer formed of polyimide (PI), an elastic layer formed of silicone rubber on an ink landing surface side of the base material layer, and a surface layer formed of perfluoroalkoxy alkane (PFA). A roller of φ 100 and having a rubber thickness of 10 mm was used as the pressure roller. A load on the transferor applied by the pressure roller was 80 N.

As the transporter, a triple size cylinder type metal drum for printer, in which the drum was capable of sucking and retaining a recording medium by an air suction chuck and transporting the recording medium, was used.

The light irradiator used was equipped with a UV-LED light source having an emission wavelength of 395 mm Irradiation intensity was 0, 0.5, and 0.8 W/cm$^2$, and duration of irradiation was 0.1 second.

The temperature controller heated the intermediate transfer body at 210° C.

As the recording medium, in order to increase sensitivity of an evaluation described below, a glass substrate was used.

Each recording medium was transported to the image forming apparatus at 600 mm/s, and a round halftone image of φ 10 mm was formed.

For comparison, the same image formation was carried out except that an intermediate transfer body without a precoat layer was used.

(Evaluation of Transfer Rate)

A transfer rate (%) from the intermediate transfer body to the recording medium was calculated as follows, and evaluated based on the following criteria. The evaluation of ○ and ⊙ are preferred.

Transfer rate (%)=Amount of ink on recording medium after transfer/Amount of ink on intermediate transfer body before transfer×100

⊙: Transfer rate of 90% or more

○: Transfer rate of 60% or more and less than 90%

Δ: Transfer rate of 30% or more and less than 60% x: Transfer rate of less than 30%

(Evaluation of Dot Destruction)

In evaluation of dot destruction, the shape of an ink dot after the ink was transferred to the recording medium was visually observed, and evaluated based on the following criteria. The evaluation of ○ is preferred.

○: No dot destruction was observed.

x: Dot destruction was observed.

Principal conditions for the image formation and results of the evaluation are shown in Table 1.

TABLE 1

| Classification | Precoat Layer | Light Irradiation Step Irradiation Intensity ($W/cm^2$) | Evaluation Results Transfer Rate | Dot Destruction |
|---|---|---|---|---|
| Experiment 1 | Exist | 0 | ⊙ | × |
| Experiment 2 | Exist | 0.5 | ○ | ○ |
| Experiment 3 | Exist | 0.8 | Δ | ○ |
| Experiment 4 | Not Exist | 0 | ⊙ | × |
| Experiment 5 | Not Exist | 0.5 | × | Evaluation Impossible |
| Experiment 6 | Not Exist | 0.8 | × | Evaluation Impossible |

As shown in Table 1, in Experiment 2 in which an ink was photo-cured after the ink was landed on an intermediate transfer body and before the landed ink was transferred to a recording medium by light having an intensity of 0.5 to 0.8 $W/cm^2$, and an outmost surface layer (precoat layer) was melted, expanded, or contracted by a temperature controller, favorable results were achieved with respect to the dot destruction evaluation.

On the other hand, in Experiments 1 and 4 in which irradiation intensities were low, the results were unsatisfactory with respect to the dot destruction evaluation. Further, in Experiments 5 and 6 in which there was no outmost surface layer (precoat layer) to be melted, expanded, or contracted by a temperature controller, transfer properties were insufficient, and the evaluation of dot destruction was impossible.

The surface energy of polypropylene used in the precoat layer before landing of the ink was 29 mN/m (25° C.). The surface energy after melting was not measured because of the high temperature. However, it was thought that the surface energy might be lower than that before landing because the temperature was higher. The surface energy at the time of ejection was 30 mN/m.

An image forming apparatus and an image forming method according to the present invention provide a favorable transfer rate from an intermediate transfer body to a recording medium and forms an image having an excellent image quality. Thus, according to the present invention, it is expected that an image forming apparatus and an image forming method which provide a favorable transfer rate and form an image having an excellent image quality become widely available.

Although embodiments of the present invention have been described and illustrated in detail, the disclosed embodiments are made for purposes of illustration and example only and not limitation. The scope of the present invention should be interpreted by terms of the appended claims

What is claimed is:

1. An inkjet-type image forming apparatus, comprising:

an intermediate transfer body that has an outmost surface layer and transfers a photo-curable ink to a recording medium;

a light irradiator that performs a preliminary curing treatment by photo-curing the photo-curable ink after the ink is landed on the intermediate transfer body and before the landed ink is transferred to the recording medium;

a temperature controller that causes the outmost surface layer to be melted, expanded, or contracted;

a transferor that transfers the photo-curable ink landed on the intermediate transfer body to the recording medium; and a photo-curer of irradiating the photo-curable ink after the ink is transferred from the intermediate transfer body to the recording medium, wherein the temperature controller is located between the light irradiator and the transferor.

2. The image forming apparatus according to claim 1, further comprising a layer former that forms the outmost surface layer.

3. The image forming apparatus according to claim 1, wherein an irradiation intensity of the light radiated from the light irradiator is 0.5 to 0.8 $W/cm^2$.

4. The image forming apparatus according to claim 1, wherein the outmost surface layer includes a thermoplastic resin, and the temperature controller causes the outmost surface layer to be melted by heating the outmost surface layer to a glass transition temperature of the thermoplastic resin or higher before the photo-curable ink is transferred to the recording medium.

5. The image forming apparatus according to claim 1, wherein the outmost surface layer includes a thermoplastic resin and a particle, and a shape of a surface of the outmost surface layer is changed to a concavo-convex shape by heating or cooling the outmost surface layer; and the temperature controller causes the outmost surface layer to be expanded or contracted by heating or cooling the outmost surface layer before the photo-curable ink is transferred to the recording medium.

6. The image forming apparatus according to claim 1, wherein a surface energy of the outmost surface layer before landing of the photo-curable ink is larger than a surface energy of the outmost surface layer after landing of the photo-curable ink.

7. The image forming apparatus according to claim 6, wherein the surface energy of the outmost surface layer after landing of the photo-curable ink is 30 mN/m or more.

8. The image forming apparatus according to claim 1, wherein the outmost surface layer does not contain an ingredient which causes aggregation of the photo-curable ink.

9. The image forming apparatus according to claim 1, wherein the temperature controller heats or cools the outmost surface layer after the preliminary curing treatment and before the transferring.

10. An inkjet-type image forming method, comprising:

irradiating light in which a preliminary curing treatment is performed by photo-curing of a photo-curable ink after the photo- curable ink is landed on an intermediate transfer body having an outmost surface layer and before the landed photo-curable ink is transferred to a recording medium;

controlling temperature in which the outmost surface layer is melted, expanded, or contracted;

transferring the photo-curable ink landed on the intermediate transfer body to the recording medium; and irradiating the photo-curable ink after the ink is transferred from the intermediate transfer body to the recording medium, wherein the temperature is controlled between the irradiating the light and the transferring the photo-curable ink.

11. The image forming method according to claim 10, wherein the outmost surface layer includes a thermoplastic resin, and in the transferring, the outmost surface layer is melted by heating the outmost surface layer to a glass transition temperature of the thermoplastic resin or higher before the photo-curable ink is transferred to the recording medium.

12. The image forming method according to claim 10, wherein the outmost surface layer includes a thermoplastic resin and a particle, and a shape of a surface of the outmost surface layer is changed to a concavo-convex shape by heating or cooling the outmost surface layer; and in the controlling temperature, the outmost surface layer is expanded or contracted by heating or cooling the outmost surface layer.

13. The image forming method according to claim 10, wherein a surface energy of the outmost surface layer before landing of the photo-curable ink is larger than a surface energy of the outmost surface layer after landing of the photo-curable ink.

14. The image forming method according to claim 12, wherein the surface energy of the outmost surface layer after landing of the photo-curable ink is 30 mN/m or more.

15. The image forming method according to claim 10, wherein the outmost surface layer does not contain an ingredient which causes aggregation of the photo-curable ink.

16. The image forming method according to claim 10, wherein in the controlling temperature, the outmost surface layer is heated or cooled after the preliminary curing treatment and before the transferring.

* * * * *